US012378782B1

(12) United States Patent
Perez

(10) Patent No.: US 12,378,782 B1
(45) Date of Patent: Aug. 5, 2025

(54) TILE SETTING DEVICE

(71) Applicant: Michael Perez, Newburgh, NY (US)

(72) Inventor: Michael Perez, Newburgh, NY (US)

( * ) Notice: Subject to any disclaimer, the term of this patent is extended or adjusted under 35 U.S.C. 154(b) by 0 days.

(21) Appl. No.: 18/923,723

(22) PCT Filed: Mar. 16, 2024

(86) PCT No.: PCT/US2024/020327

§ 371 (c)(1),
(2) Date: Oct. 23, 2024

(51) Int. Cl.
*E04F 21/18* (2006.01)

(52) U.S. Cl.
CPC ..... *E04F 21/1888* (2013.01)

(58) Field of Classification Search
CPC ..... E04F 21/1816; E04F 21/1838; E04F 21/1872; E04F 21/1888
USPC ..... 52/122.1; 269/21
See application file for complete search history.

(56) References Cited

U.S. PATENT DOCUMENTS 2,855,653 A * 10/1958 Kastenbein ..... E04F 21/1888 269/21
3,460,822 A * 8/1969 Link ..... B25B 11/005 269/21
3,630,389 A * 12/1971 Schmidt ..... B25J 3/04 414/743
4,091,945 A * 5/1978 Patterson ..... E04F 21/1888 206/322
4,583,343 A * 4/1986 Camp ..... E04F 21/20 52/749.11
4,674,785 A * 6/1987 Riesenberg ..... B66C 1/0293 294/186
4,676,713 A * 6/1987 Voelpel ..... B66F 9/181 901/29
4,893,451 A * 1/1990 Valente ..... E04F 21/1888 52/749.11
5,387,068 A * 2/1995 Pearson ..... B25J 15/0616 414/404
5,617,698 A * 4/1997 Guilmette ..... E04F 21/1844 52/749.1
5,632,590 A * 5/1997 Pearson ..... B25J 15/0616 414/789.5

(Continued)

FOREIGN PATENT DOCUMENTS

CN 2780894 Y 5/2006
CN 104963492 A 10/2015

(Continued)

*Primary Examiner* — James M Ference
(74) *Attorney, Agent, or Firm* — McCoy Russell LLP

(57) ABSTRACT

The tile setting device includes a tile staging tray and a tile gripping apparatus that picks up an array of tiles from the tray using a series of vacuum suction cups. The vacuum is provided by compressed air flowing through venturis mounted to the upper planar panel of the gripping apparatus. An intermediate planar panel includes passageways that direct the vacuum from the venturis to an array of suction cups attached to or removed from the lower planar panel of the gripping apparatus. When removed, to avoid suction over a tile seam or open space, the suction cups are replaced with a sealing cap. Adjustable guides extend from each side edge of the gripping apparatus to position the tiles adjacent tiles that are already in place, a wall or other mounting feature. Gripping handles on the upper planar panel to aid in positioning the gripping apparatus with attached tile arrays.

6 Claims, 13 Drawing Sheets

(56) References Cited

U.S. PATENT DOCUMENTS

| | | | | | |
|---|---|---|---|---|---|
| 5,735,512 | A * | 4/1998 | Waddell | B25B 11/005 | 269/21 |
| 5,775,395 | A * | 7/1998 | Wilkins | B25H 7/02 | 144/286.5 |
| 5,996,297 | A * | 12/1999 | Keith | E04C 5/20 | 52/685 |
| 6,138,981 | A * | 10/2000 | Keith | E04G 11/18 | 249/19 |
| 7,168,698 | B2 * | 1/2007 | Kawamura | B65H 5/10 | 271/96 |
| 8,267,386 | B2 * | 9/2012 | Schaaf | B65G 47/91 | 269/21 |
| 10,384,433 | B2 * | 8/2019 | Rodriguez | B32B 43/006 | |
| 11,007,814 | B1 * | 5/2021 | Zhan | B25J 1/00 | |
| 2019/0024392 | A1 * | 1/2019 | Naccarato | B62B 1/04 | |
| 2020/0024853 | A1 * | 1/2020 | Furrer | B25J 9/163 | |
| 2022/0297317 | A1 * | 9/2022 | Olea | B65B 1/24 | |

FOREIGN PATENT DOCUMENTS

| | | | |
|---|---|---|---|
| DE | 7832894 | U1 | 5/1980 |
| DE | 3411882 | A | 10/1985 |
| DE | 9318902 | U | 12/1993 |
| DE | 102017119554 | A1 | 2/2019 |
| EP | 964115 | A1 | 12/1999 |
| NL | 8503510 | A | 7/1987 |

* cited by examiner

TILE SETTING DEVICE

RELATED APPLICATION

The present invention is a U.S. National Phase of PCT Application No. PCT/US2024/020327, filed Mar. 16, 2024 and currently pending.

FIELD OF INVENTION

The present invention relates to a device for rapid and accurate positioning of tiles upon a mounting surface. More particularly, the invention relates to a system for staging tiles in a containment fixture prior to installation, positioning the tiles in a desired alignment, lifting the tiles out of the containment fixture with a gripping mechanism while still in alignment, positioning the tiles on the mounting surface and releasing the gripping mechanism.

BACKGROUND OF THE INVENTION

Installing tiles is strenuous physical labor that requires a high degree of precision to produce quality tiled surfaces. The skilled labor to do this work is expensive and the time spent doing the installation must be controlled for the work to be profitable. A device that can ensure accurate alignment of the tiles while making them easy to lift into place and align with other tiles or fixtures can make the installation accurate and efficient. The present invention achieves these goals.

An example of a tile setting apparatus can be seen in U.S. Pat. No. 4,091,945 issued to Thomas P. Patterson on May 30, 1978. A tile setting apparatus is disclosed which includes a tile holder box for both holding and aligning tiles preparatory to installation of the tiles and a tile setter tool which is releasably secured to the tiles in the tile holder box and removes a plurality of the aligned tiles from the tile holder for placement of the tile for installation. When tiles are picked up by the tile setter by the vacuum process, the user of the apparatus lifts the tiles and places the tiles as desired, usually on a vertically extending wall. When the tiles are in their proper place or orientation on a wall, or more particularly on an adhesive surface on a wall, a thumb release valve is actuated to allow air to flow into the air chamber which thus relieves the vacuum and causes the suction cups to be released from the tiles.

U.S. Pat. No. 11,007,814, issued to Hui Zhan on May 18, 2021, describes a tile gripper with a number of suction cups. The invention provides a mosaic tile paving device which includes a series of suckers and a handle. The suckers are installed on a vacuumizing shell, and the suckers and mosaic tile can be fixed together and separated by changing the air volume in the vacuumizing shell. The vacuumizing shell is connected with a handle. Specifically, the suckers are fixed at the bottom of the vacuumizing shell horizontally and vertically. After the suckers are pasted on all small tiles of the mosaic tile, the air of vacuumizing shell can be discharged manually.

U.S. Pat. No. 4,583,343, issued to Dariel R. Camp on Apr. 22, 1986, describes discloses a tile setting kit for uniform placement of ceramic-type tiles, particularly for setting tiles on a vertical surface. The tile setting kit includes a starter rack with uniformly displaced spacers for the first course of tiles; an elongated guide frame having replaceable spacer rails with a plurality of uniformly spaced cross teeth arranged in accordance with selected size tile, the frame having further a bubble level for tile course alignment and a support structure with a brace arm and suction attachment that engages the adjacent lower course of set tiles; a spacer unit with suction attachment for support under the adjacent lower course to prevent slippage; and, a tile gun with a releasable suction grip for picking up and placing individual tiles.

U.S. Pat. No. 10,384,433, issued to Mauricio Ricardo Rodriguez on Aug. 20, 2019, describes attachment bases that hold an oscillator to the surface of target object through vacuum suction. Some embodiments may use a venturi, to generate vacuum suction, while others may use a pump. Instead of a venturi, other methods and structures of creating a vacuum, including but not limited to a vacuum generator, mechanical pump, or manual pump, are also contemplated to achieve the desired function of holding an oscillator to a target object. Vacuum engagement may be enhanced with the use of an attachment such as a gel or liquid applied to the surface of the target object prior to engagement of the vacuum.

U.S. Pat. No. 4,893,451, issued to Pietro Valente on Jan. 16, 1990, describes a device having the suction cup operatively connected a vacuum generator of standard construction, and a vibrator. The vacuum generator and vibrator are mounted on a base of the enclosure. When the tile is pressed against the adhesive, the vibrator starts to vibrate, this will produce a corresponding vibration in the entire enclosure and therefore the suction cup will start to vibrate. This helps embed the tile into the adhesive.

U.S. Pat. No. 8,267,386, issued to Walter Schaaf on Sep. 18, 2012, describes a pneumatically actuated area vacuum gripper for gripping and, if necessary, separating workpieces. In particular, the vacuum gripper is used with thin, flexible workpieces, and has a suction chamber, which has a suction wall with perforations, to be placed on the workpiece. An ejector nozzle has a connection and an outlet, the ejection nozzle being connected to the suction chamber via its connection, and the outlet of the ejector nozzle opening to the outside or into an exhaust air duct, and the suction inlet of the ejector nozzle empties into the suction chamber, whereby the direction of the air stream in the connection coming from the suction chamber corresponds to the direction of the main air conveyance in the ejector nozzle.

It is an objective of the present invention to provide a tray for organizing and aligning a quantity of tiles for later installation on a mounting surface. It is a further objective to provide a means for positioning the tiles within the tray. It is a still further objective, to provide a gripping device to attach to the tiles positioned in the tray so that they may be moved to a mounting site. It is yet a further objective to provide a means to align the tiles held by the gripping device with other already positioned tiles or a fixture. It is still a further objective to provide a means for accurately trimming tiles held by the device. Finally, it is an objective of the present invention to provide a means to release the gripped tiles once positioned at the mounting surface.

While some of the objectives of the present invention are disclosed in the prior art, none of the inventions found include all the requirements identified.

SUMMARY OF THE INVENTION

The present invention addresses all of the deficiencies of prior tile setting inventions and satisfies all of the objectives described above.

1) A tile setting device can be constructed from the following components. A tile gripping apparatus is provided. The tile gripping apparatus includes a lower planar panel, an intermediate planar panel, an upper planar panel, at least one vacuum operated suction cup, a positioning handle, a compressed air source, at least one venturi, a compressed air control valve and at least one adjustable guide. The lower planar panel has at least one fitting.

The at least one fitting is adapted for attachment of the at least one vacuum operated suction cup or a closing cap and provides a passageway to an upper surface of the lower planar panel. The intermediate planar panel is located above the lower planar panel and has at least one air-tight chamber. The at least one air-tight chamber is fluidly connected to the at least one fitting and fluidly connected to an orifice in an upper surface of the intermediate planar panel. The upper planar panel is located above the intermediate planar panel and provides a mounting surface for the at least one venturi and attachment points for the positioning handle. The at least one venturi is fluidly connected to the orifice through an opening in a lower surface of the upper planar panel. The compressed air source is fluidly connected to the compressed air control valve. The compressed air control valve is fluidly connected to the at least one venturi.

2) In a variant of the invention, a tile staging tray is provided. The tile staging tray has a flat bottom, an open top, a left side wall, a right side wall, a front wall and a back wall. The left side, right side, front and back walls extend above the flat bottom to a first predetermined height. The first predetermined height is sufficient to accommodate at least one layer of tile and at least a bottom edge of a lower planar panel of the tile gripping apparatus. The at least one adjustable guide is adjustably attached adjacent an edge of the upper planar panel and provides a means for positioning the tile gripping apparatus adjacent one of the left side, right side, front or back walls of the tile staging tray or for positioning the tile gripping apparatus adjacent a surface mounting feature or positioned array of tiles. When the at least one layer of tile is located within the staging tray with the at least one layer of tile positioned against one of the left side wall, right side wall, front wall or back wall, the tile gripping apparatus is positioned on top of the at least one layer of tile with the at least one adjustable guide positioned against one of the left side wall, right side wall, front wall or back wall and the compressed air control valve is activated to provide vacuum to the at least one vacuum operated suction cup. The tile gripping apparatus will be attached to the at least one layer of tile and the at least one layer of tile may be removed from the tile staging tray and positioned upon a mounting surface. The compressed air control valve is then activated and the vacuum is released from the at least one vacuum operated suction cup and the tile gripping apparatus is removed from the at least one layer of tile.

3) In a variant of the invention, the compressed air control valve is adjustably mounted to the positioning handle.

4) In another variant, the at least one venturi includes at least two venturis. Each of the at least two venturis is serially connected and has a shut-off valve for deactivation of each of the at least two venturis.

5) In still another variant, the right side wall and the back wall of the tile staging tray are of a height less than the first predetermined height, thereby augmenting removal of the tile gripping apparatus and the at least one layer of tiles attached to the at least one vacuum operated suction cup from the tile staging tray.

6) In yet another variant, the back wall of the tile staging tray is of a height less than the first predetermined height, thereby augmenting removal of the tile gripping apparatus and the at least one layer of tiles attached to the at least one vacuum operated suction cup from the tile staging tray.

7) In a final variant of the invention, the at least one adjustable guide includes an adjustable guide disposed adjacent to each edge of the upper planar panel of the tile gripping apparatus.

DETAILED DESCRIPTION OF THE PREFERRED EMBODIMENT

Figure 15:
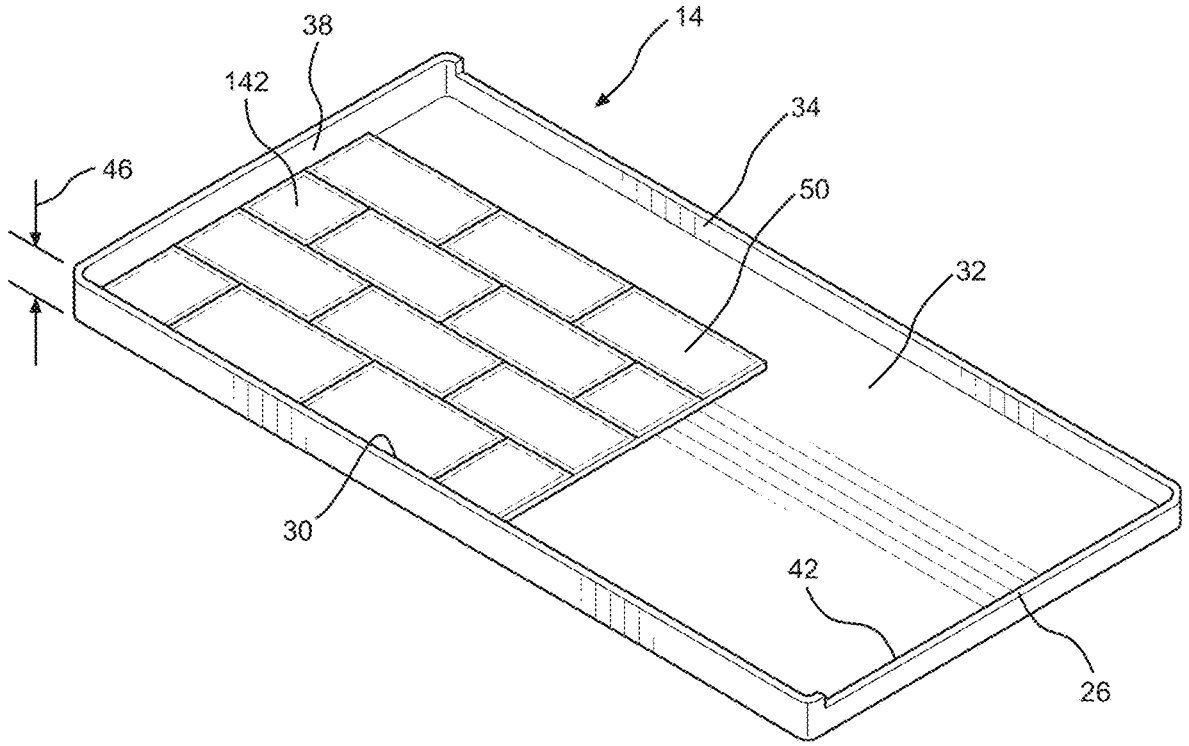
FIG. 15 is a perspective view of the tile staging tray used with the FIG. 1 embodiment.

1) As illustrated in FIG. 15, a tile staging tray 14 is provided. The tile staging tray 14 has a flat bottom 22, an open top 26, a left side wall 30, a right side wall 34, a front wall 38 and a back wall 42. The left side 30, right side 34, front 38 and back 42 walls extend above the flat bottom 22 to a first predetermined height 46. The first predetermined height 46 is sufficient to accommodate at least one layer of tile 50 and at least the bottom edge 54 of the lower planar panel 58 of the tile gripping apparatus 18. The at least one adjustable guide 90 is adjustably attached adjacent an edge 135, 138 of the upper planar panel 66 and provides a means for positioning the tile gripping apparatus 18 adjacent one of the left side 30, right side 34, front 38 or back 42 walls of the tile staging tray 14 or for positioning the tile gripping apparatus 18 adjacent a surface mounting feature (not shown) or positioned array of tiles 146 (not shown). When the at least one layer of tile 50 is located within the tile staging tray 14 with the at least one layer of tile 50 positioned against one of the left side wall 30, right side wall 34, front wall 38 or back wall 42, the tile gripping apparatus 18 is positioned on top 142 of the at least one layer of tile 50 with the at least one adjustable guide 90 positioned against one of the left side wall 30, right side wall 34, front wall 38 or back wall 42 and the compressed air control valve 86 is activated to provide vacuum to the at least one vacuum operated suction cup 70. The tile gripping apparatus 18 will be attached to the at least one layer of tile 50 and the at least one layer of tile 50 may be removed from the tile staging tray 14 and positioned upon a mounting surface 150 (not shown). The compressed air control valve 86 is then activated and the vacuum is released from the at least one vacuum operated suction cup 70 and the tile gripping apparatus 18 is removed from the at least one layer of tile 50.

2) As illustrated in FIG. 15, a tile staging tray 14 is provided. The tile staging tray 14 has a flat bottom 22, an open top 26, a left side wall 30, a right side wall 34, a front wall 38 and a back wall 42. The left side 30, right side 34, front 38 and back 42 walls extend above the flat bottom 22 to a first predetermined height 46. The first predetermined height 46 is sufficient to accommodate at least one layer of tile 50 and at least the bottom edge 54 of the lower planar panel 58 of the tile gripping apparatus 18. The at least one adjustable guide 90 is adjustably attached adjacent an edge 138 of the upper planar panel 66 and provides a means for positioning the tile gripping apparatus 18 adjacent one of the left side 30, right side 34, front 38 or back 42 walls of the tile staging tray 14 or for positioning the tile gripping apparatus 18 adjacent a surface mounting feature (not shown) or positioned array of tiles 146 (not shown). When the at least one layer of tile 50 is located within the tile staging tray 14 with the at least one layer of tile 50 positioned against one of the left side wall 30, right side wall 34, front wall 38 or back wall 42, the tile gripping apparatus 18 is positioned on top 142 of the at least one layer of tile 50 with the at least one adjustable guide 90 positioned against one of the left side wall 30, right side wall 34, front wall 38 or back wall 42 and the compressed air control valve 86 is activated to provide vacuum to the at least one vacuum operated suction cup 70. The tile gripping apparatus 18 will be attached to the at least one layer of tile 50 and the at least one layer of tile 50 may be removed from the tile staging tray 14 and positioned upon a mounting surface 150 (not shown). The compressed air control valve 86 is then activated and the vacuum is released from the at least one vacuum operated suction cup 70 and the tile gripping apparatus 18 is removed from the at least one layer of tile 50.

Figure 1:
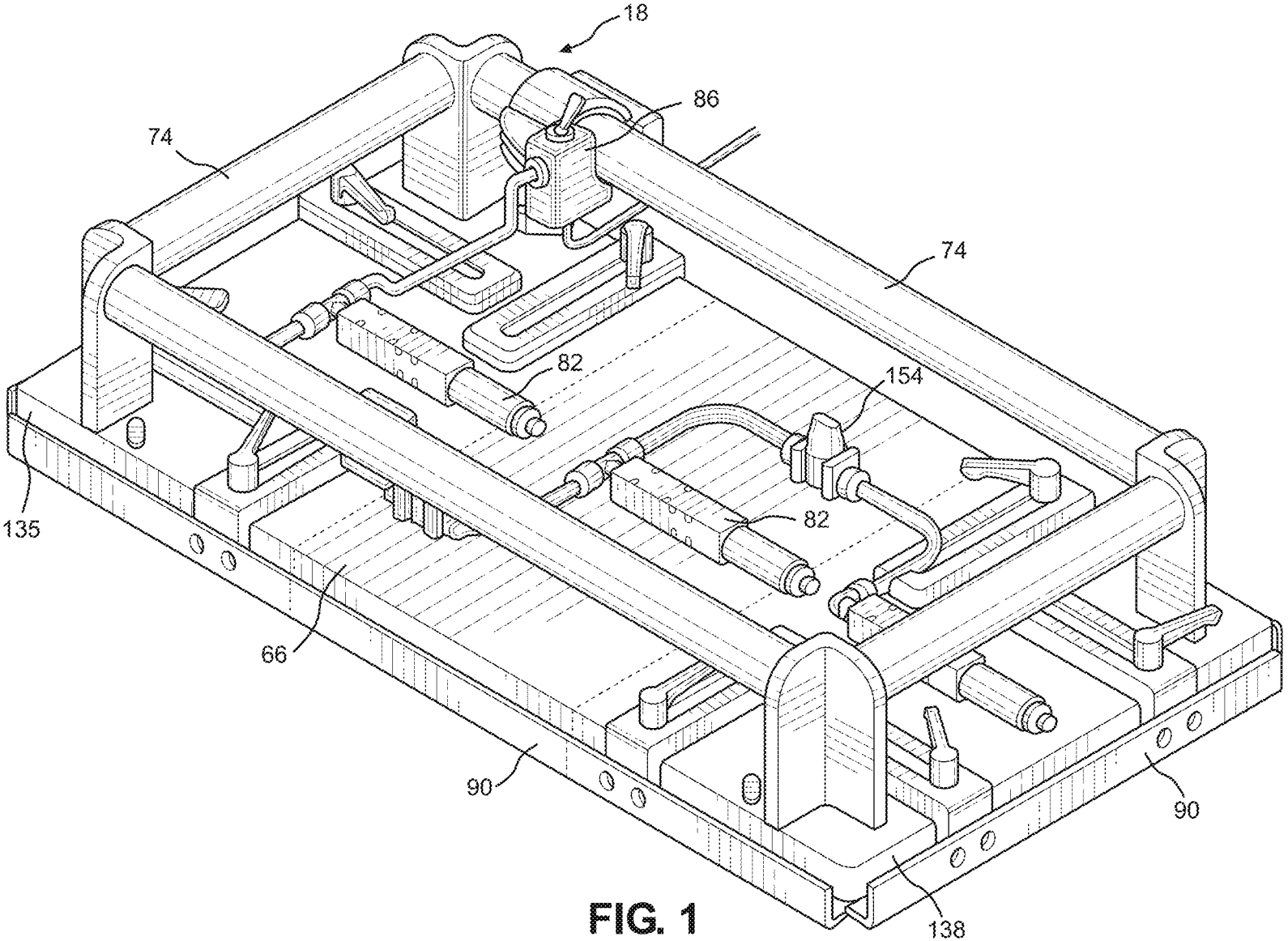
FIG. 1 is a perspective view of the preferred embodiment of the tile gripping apparatus of the invention, illustrating the upper planar surface, the venturis, the compressed air control valve and adjustable guides and positioning handles.
Figure 2:
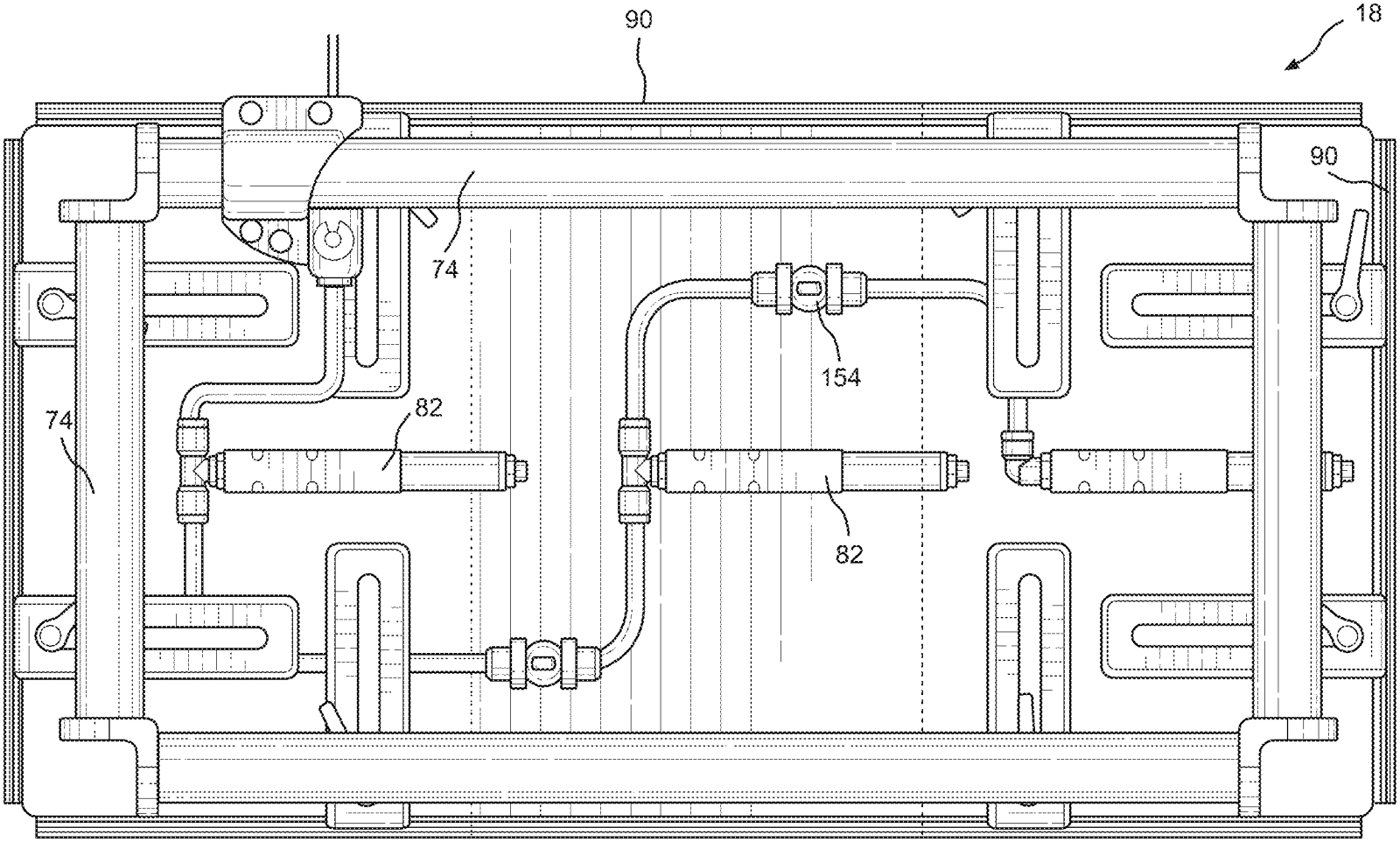
FIG. 2 is a top view of the FIG. 1 embodiment with the adjustable guides retracted.
Figure 3:
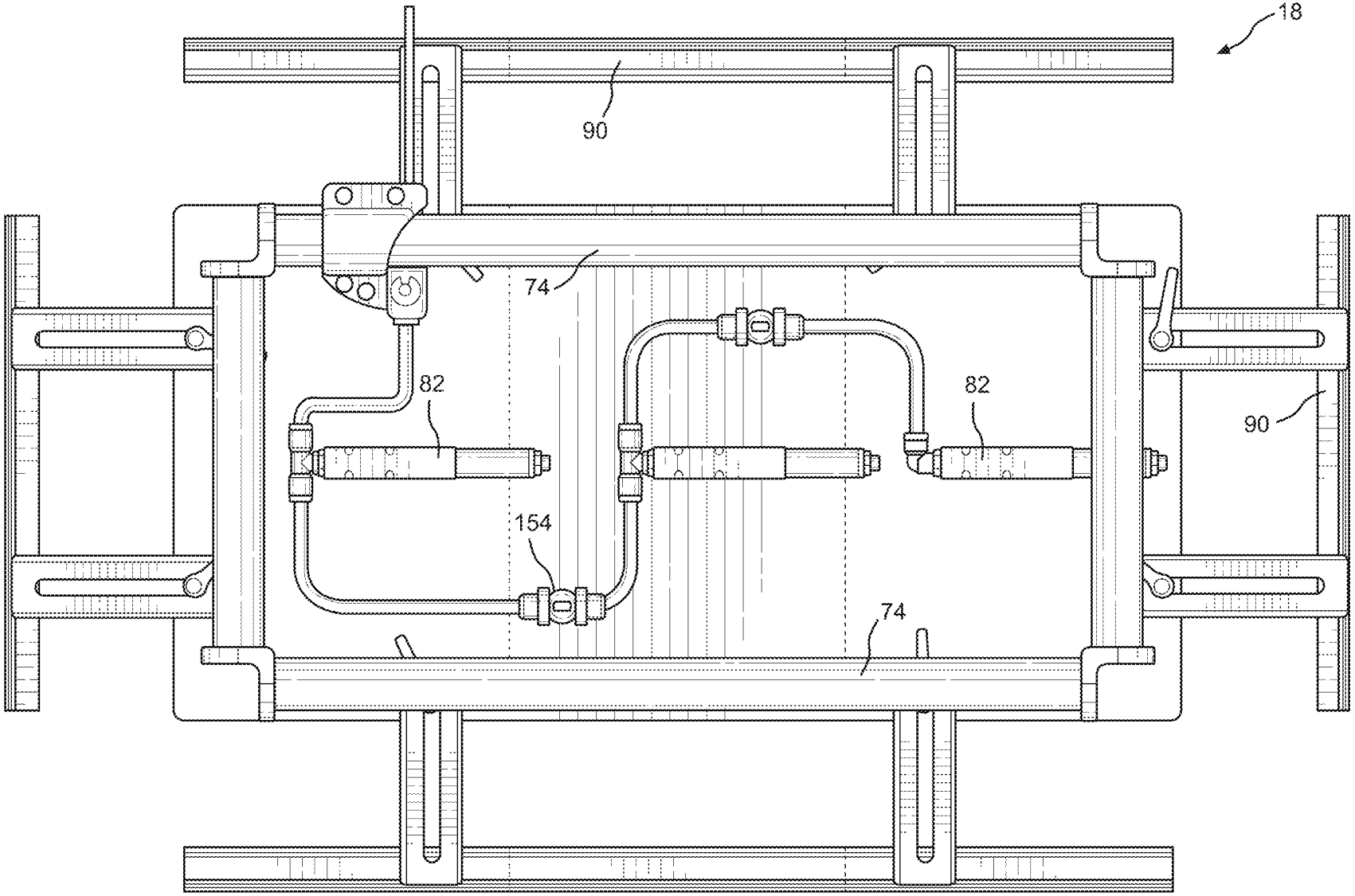
FIG. 3 is a top view of the FIG. 1 embodiment with the adjustable guides extended.
Figure 4:
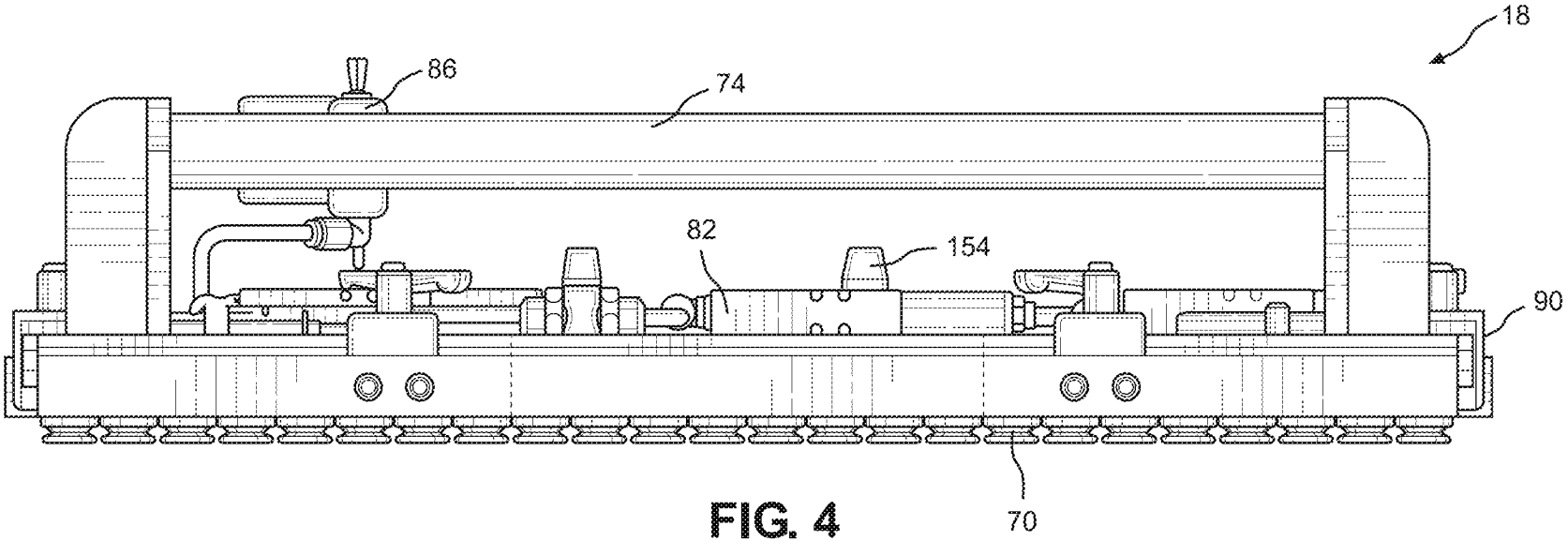
FIG. 4 is a right side elevational view of the FIG. 1 embodiment with the adjustable guides retracted.
Figure 5:
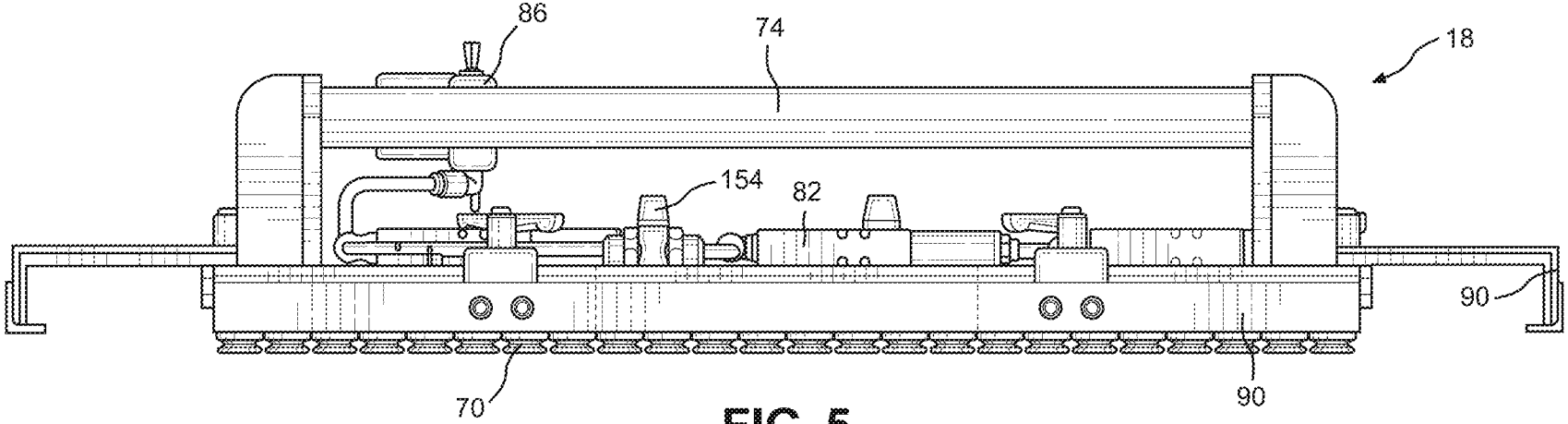
FIG. 5 is a right side elevational view of the FIG. 1 embodiment with the adjustable guides extended.
Figure 6:
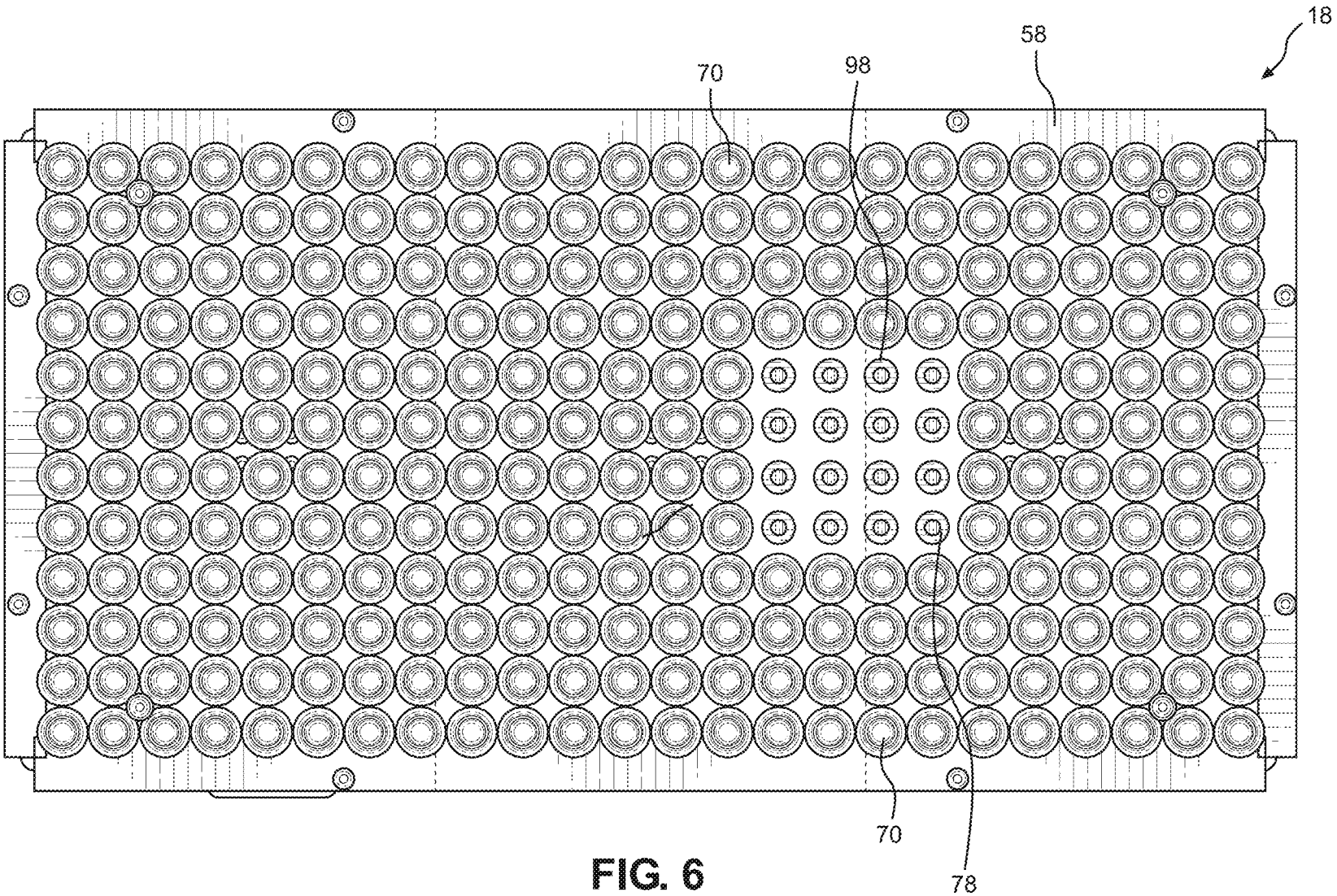
FIG. 6 is a bottom view of the FIG. 1 embodiment, illustrating the lower planar surface with attached suction cups and closing caps.
Figure 7:
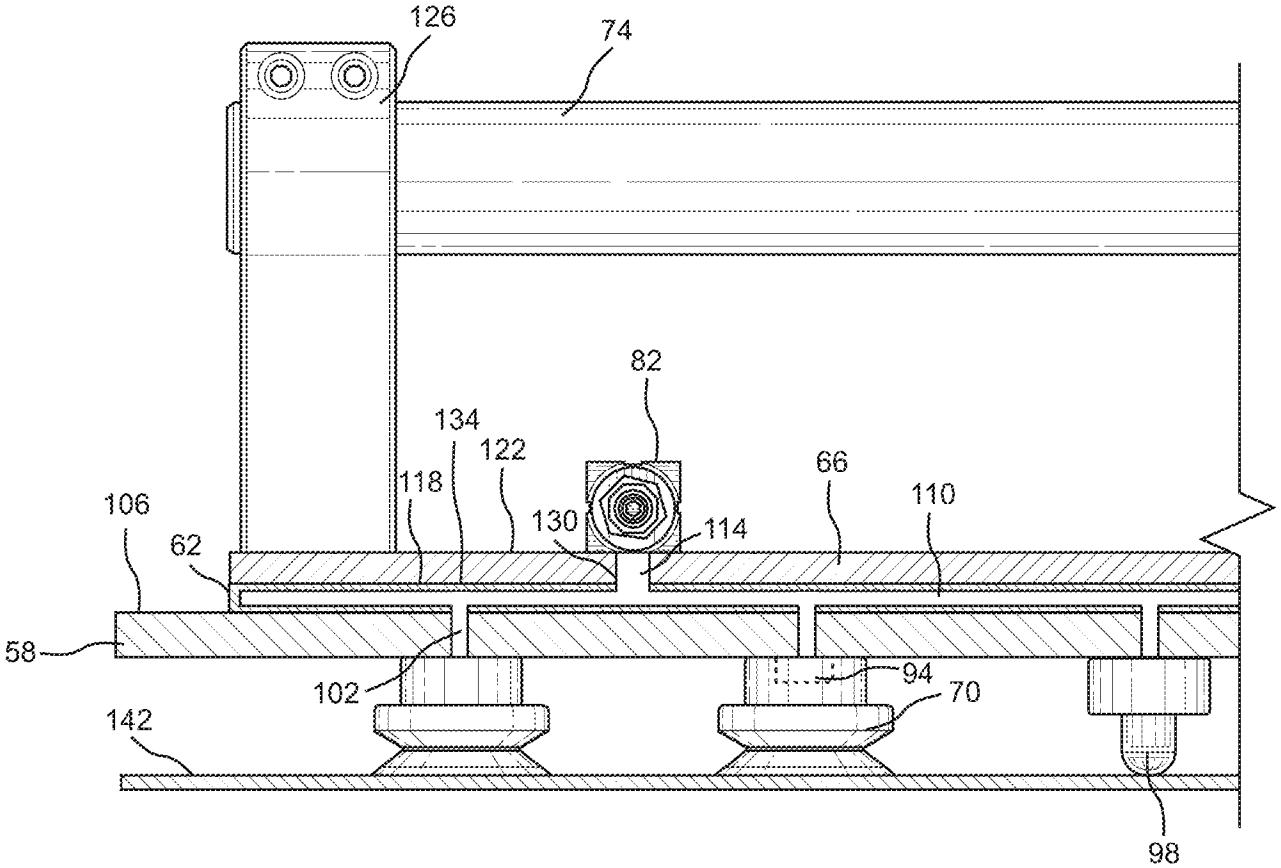
FIG. 7 is a partial end cross-sectional view of the FIG. 1 embodiment, illustrating a venturi, passageways from the venturi through the upper planar panel, through the intermediate planar panel and through the lower planar panel to the suction cups and closing cap and an attached layer of tile.
Figure 8:
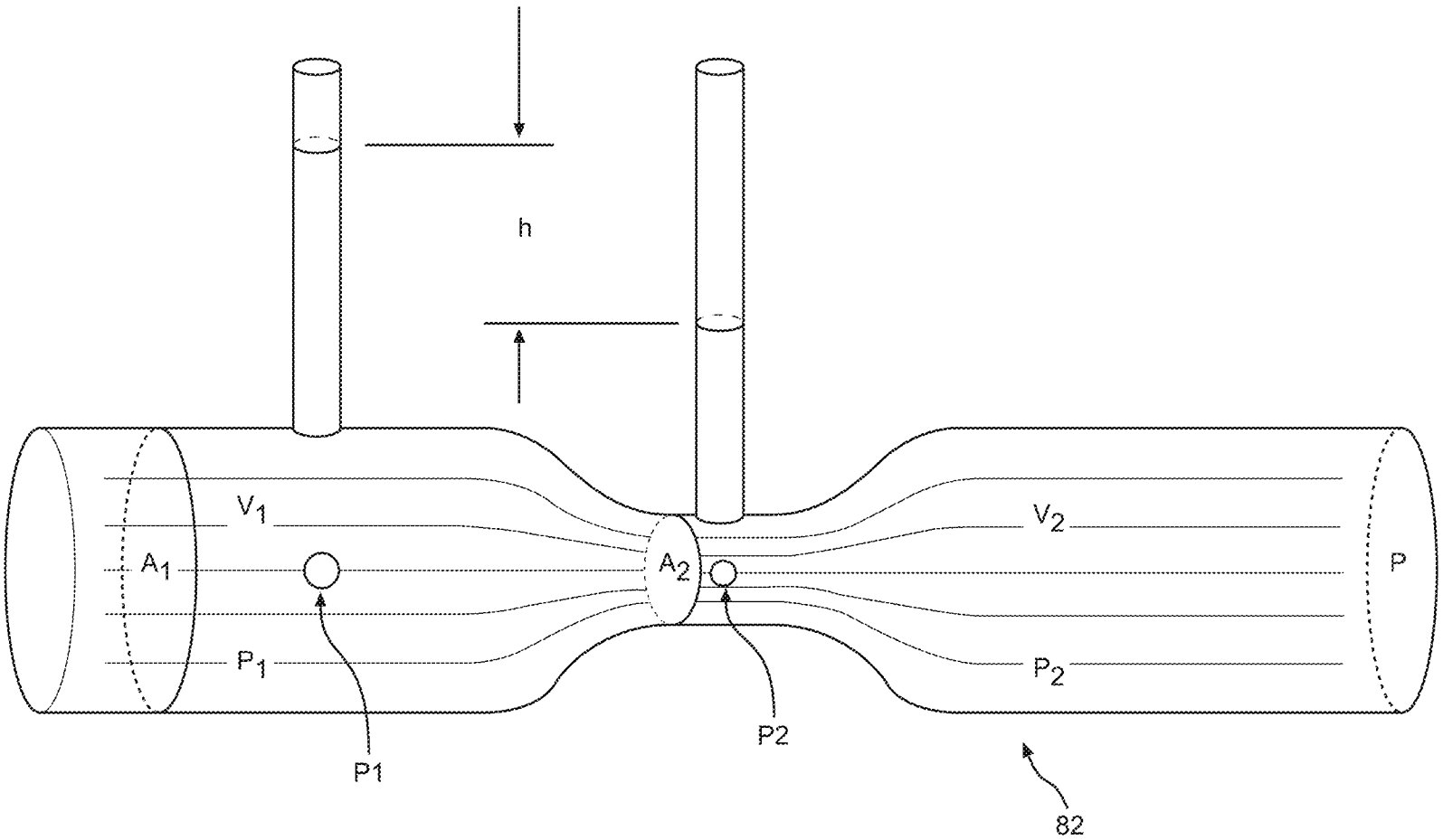
FIG. 8 is a perspective view of a venturi, illustrating how it uses compressed air to provide a vacuum for the suction cups.
Figure 10:
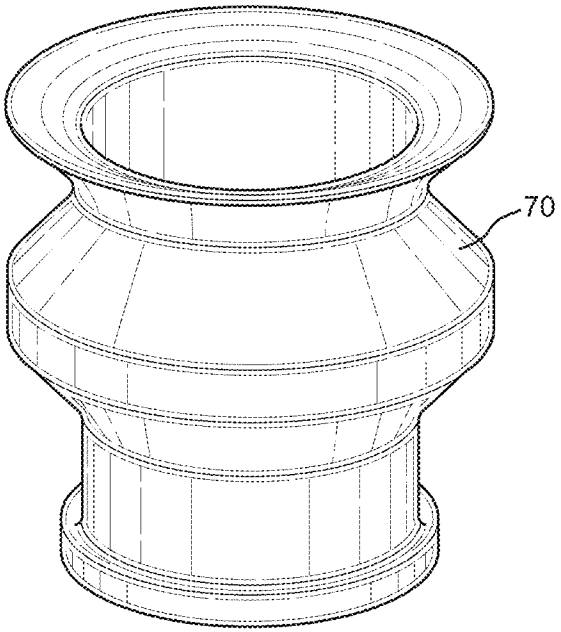
FIG. 10 is a perspective view of a suction cup.
Figure 9:
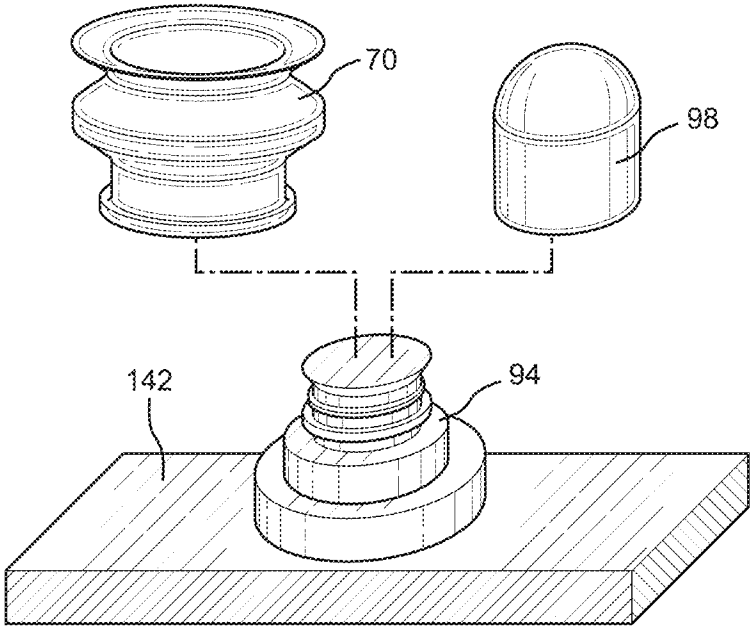
FIG. 9 is a perspective illustration of the attachment of a suction cup or closing cap to the lower planar panel.
Figure 11:
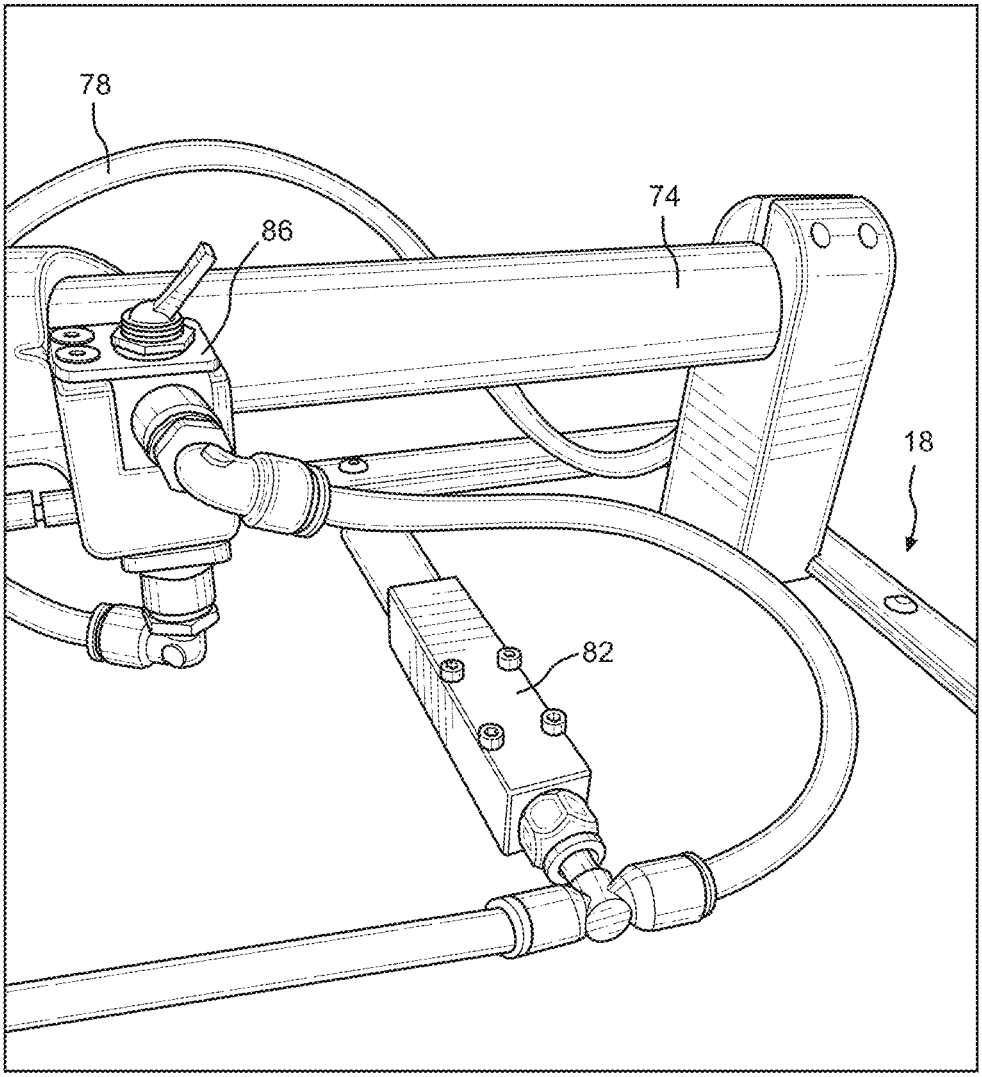
FIG. 11 is a close-up perspective view of the compressed air control valve, hose connections and a venturi of the FIG. 1 embodiment.
Figure 12:
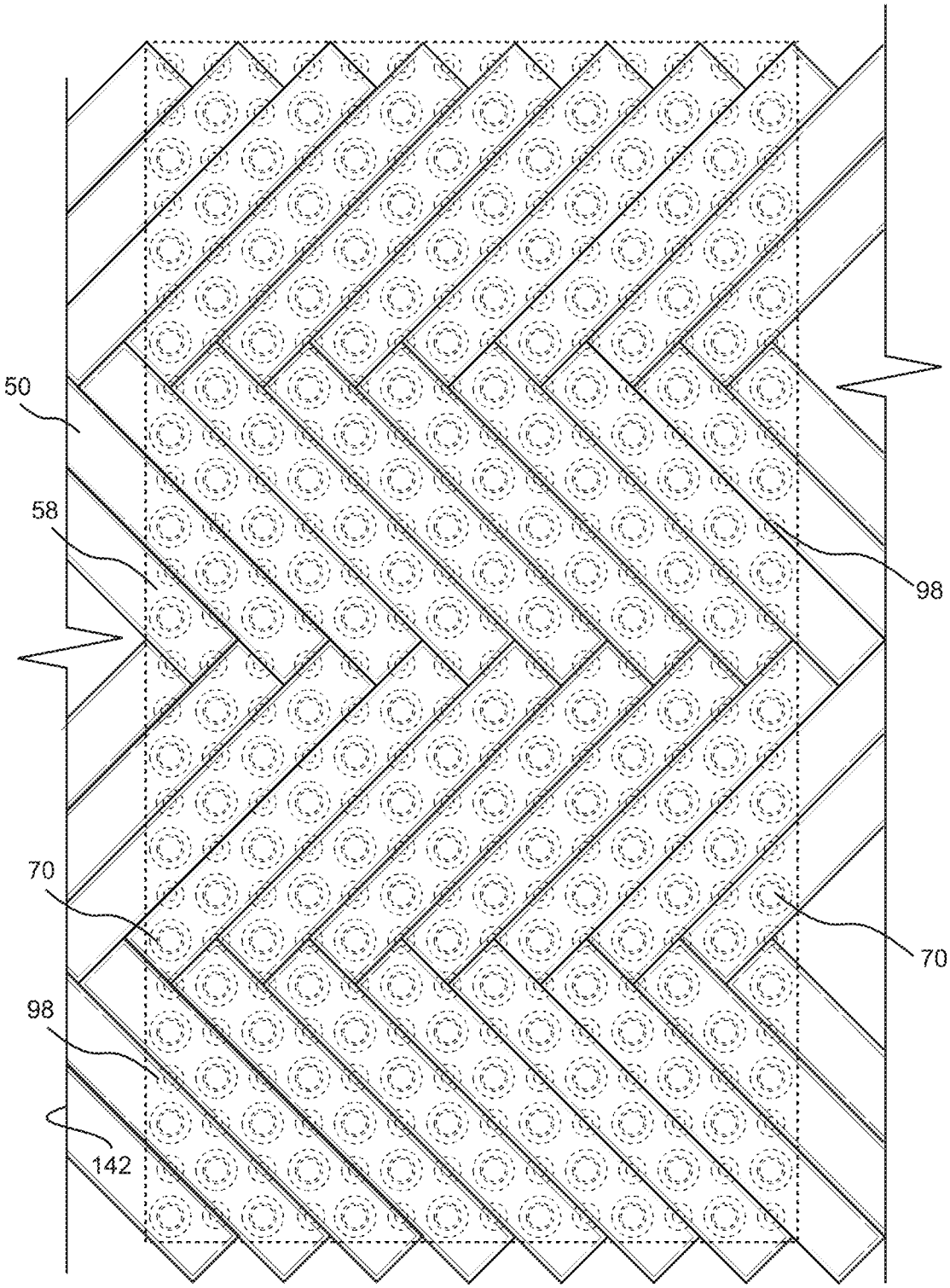
FIG. 12 is an underside view of the FIG. 1 embodiment after picking up an array of herring bone pattern tiles.
Figure 13:
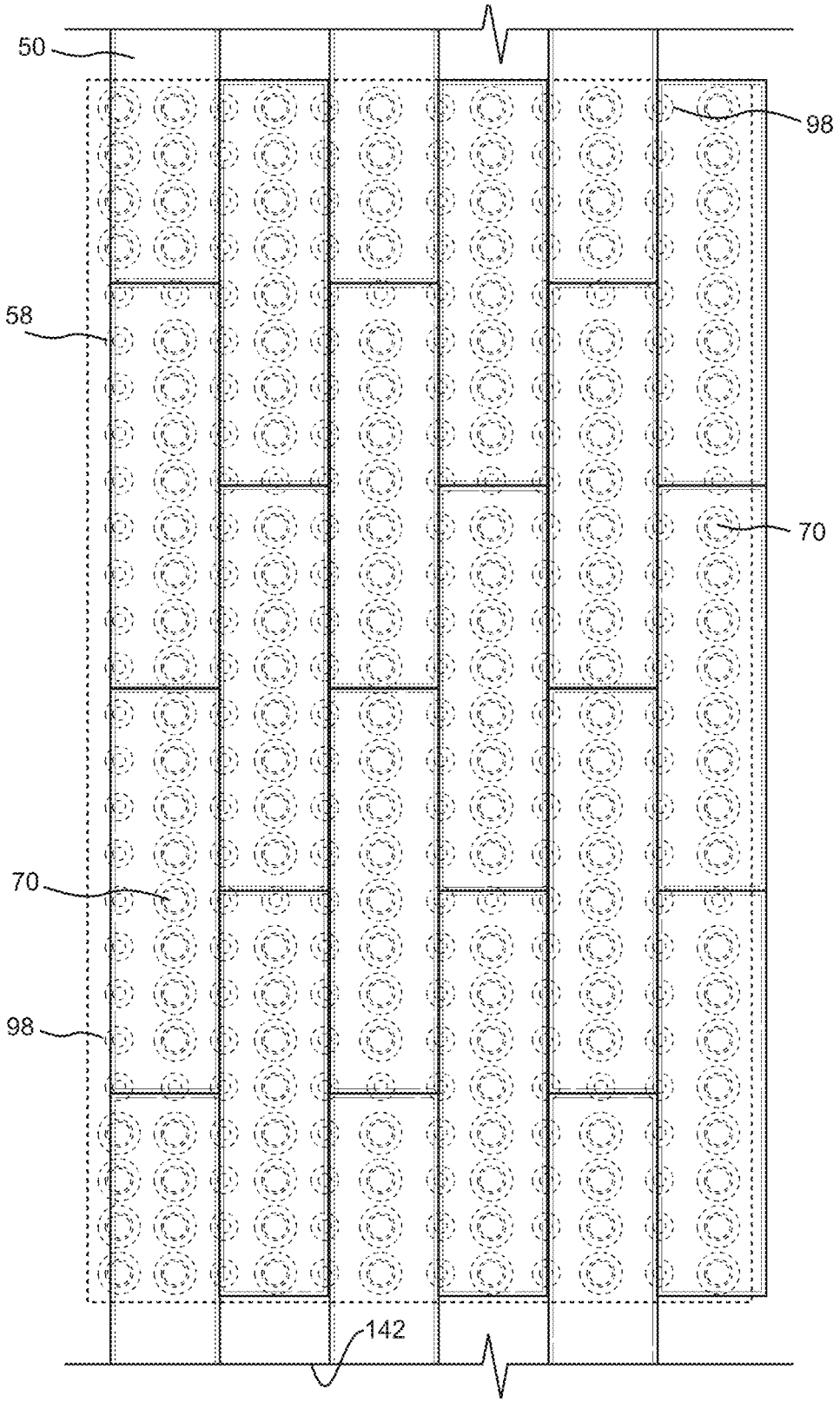
FIG. 13 is an underside view of the FIG. 1 embodiment after picking up an array of rectangular pattern tiles with alternating tiles extending beyond three of the edges of the lower planar panel.
Figure 14:
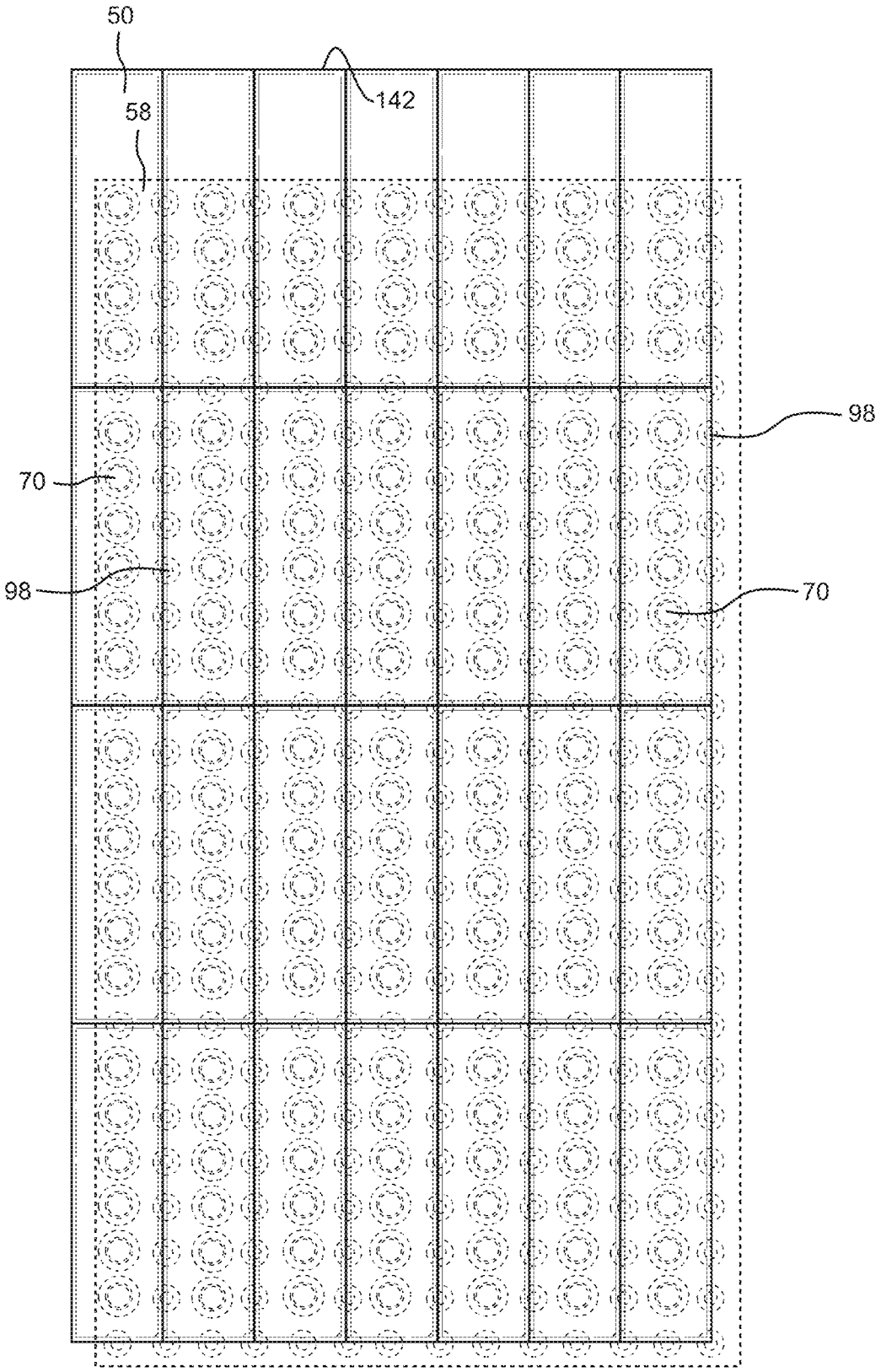
FIG. 14 is an underside view of the FIG. 1 embodiment after picking up an array of rectangular pattern tiles with tiles extending beyond two of the edges of the lower planar panel.

3) In a variant of the invention, as illustrated in FIG. 1, the compressed air control valve 86 is adjustably mounted to the positioning handle 74.

4) In another variant, the at least one venturi 82 includes at least two venturis 82. Each of the at least two venturis 82 is serially connected and has a shut-off valve 154 for deactivation of each of the at least two venturis 82.

5) In still another variant, as illustrated in FIG. 15, the right side wall 34 and the back wall 42 of the tile staging tray 14 are of a height 158 less than the first predetermined height 46, thereby augmenting removal of the tile gripping apparatus 18 and the at least one layer of tile 50 attached to the at least one vacuum operated suction cup 70 from the tile staging tray 14.

6) In yet another variant, the back wall 42 of the tile staging tray 14 is of a height 158 less than the first predetermined height 46, thereby augmenting removal of the tile gripping apparatus 18 and the at least one layer of tile 50 attached to the at least one vacuum operated suction cup 70 from the tile staging tray 14.

7) In a final variant of the invention, as illustrated in FIG. 2-5, the at least one adjustable guide 90 includes an adjustable guide 90 located adjacent to each edge 138 of the upper planar panel 66 of the tile gripping apparatus 18.

The invention claimed is:

1. A tile setting device, comprising:

a tile gripping apparatus;

said tile gripping apparatus comprising a lower planar panel, an intermediate planar panel, an upper planar panel, at least one vacuum operated suction cup, a positioning handle, a compressed air source, at least one venturi, a compressed air control valve and at least one adjustable guide;

said lower planar panel having at least one fitting, said at least one fitting being adapted for attachment of said at least one vacuum operated suction cup or a closing cap and providing a passageway to an upper surface of said lower planar panel;

said intermediate planar panel being disposed above said lower planar panel and having at least one air-tight chamber, said at least one air-tight chamber being fluidly connected to said at least one fitting and fluidly connected to an orifice in an upper surface of said intermediate planar panel;

said upper planar panel being disposed above said intermediate planar panel and providing a mounting surface for said at least one venturi and attachment points for said positioning handle;

said at least one venturi being fluidly connected to said orifice through an opening in a lower surface of said upper planar panel;

said compressed air source being fluidly connected to said compressed air control valve, said compressed air control valve being fluidly connected to said at least one venturi;

a tile staging tray, said tile staging tray having a flat bottom, an open top, a left side wall, a right side wall, a front wall and a back wall, said left side wall, said right side wall, said front wall and said back wall each extending above said flat bottom to a first predetermined height, said first predetermined height sufficient to accommodate at least one layer of tile and at least a bottom edge of said lower planar panel of said tile gripping apparatus, said at least one adjustable guide being adjustably attached adjacent an edge of said upper planar panel and providing a means for positioning said tile gripping apparatus adjacent one of said left side, right side, front wall or back wall of said tile staging tray or for positioning said tile gripping apparatus adjacent a surface mounting feature or a positioned array of tiles; and whereby, when said at least one layer of tile is disposed within said tile staging tray with said at least one layer of tile positioned against one of said left side wall, right side wall, front wall or back wall, said tile gripping apparatus is configured to be positioned on top of said at least one layer of tile with said at least one adjustable guide configured to be positioned against one of said left side wall, right side wall, front wall or back wall and said compressed air control valve is configured to be activated to provide a vacuum to said at least one vacuum operated suction cup, said tile gripping apparatus is configured to be attached to said at least one layer of tile and said at least one layer of tile is configured to be removed from said tile staging tray and is configured to be positioned upon a mounting surface, said compressed air control valve is configured to be activated and said vacuum is configured to be released from said at least one vacuum operated suction cup and said gripping apparatus is configured to be removed from said at least one layer of tile.

2. The tile setting device as described in claim 1, wherein said compressed air control valve is adjustably mounted to said positioning handle.

3. The tile setting device as described in claim 1, wherein said at least one venturi comprises at least two venturis, each of said at least two venturis being serially connected and having a shut-off valve for deactivation of each of said at least two venturis.

4. The tile setting device as described in claim 1, wherein said right side wall and said back wall of said tile staging tray are of a height less than said first predetermined height, thereby augmenting removal of said tile gripping apparatus and the at least one layer of tiles attached to said at least one vacuum operated suction cup from said tile staging tray.

5. The tile setting device as described in claim 1, wherein said back wall of said tile staging tray is of a height less than said first predetermined height, thereby augmenting removal of said tile gripping apparatus and the at least one layer of tile attached to said at least one vacuum operated suction cup from said tile staging tray.

6. The tile setting device as described in claim 1, wherein said edge of said upper planar panel of said tile gripping apparatus comprises a plurality of edges, and wherein said at least one adjustable guide comprises an adjustable guide disposed adjacent to each of the plurality of edges of said upper planar panel of said tile gripping apparatus.

* * * * *